US009701919B2

(12) United States Patent
Atarashiya et al.

(10) Patent No.: US 9,701,919 B2
(45) Date of Patent: Jul. 11, 2017

(54) COAL INACTIVATION PROCESSING APPARATUS

(71) Applicant: MITSUBISHI HEAVY INDUSTRIES, LTD., Tokyo (JP)

(72) Inventors: Kenji Atarashiya, Tokyo (JP); Tsutomu Hamada, Tokyo (JP); Fumiaki Sato, Tokyo (JP); Masakazu Sakaguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 2 days.

(21) Appl. No.: 14/769,942

(22) PCT Filed: Jan. 20, 2014

(86) PCT No.: PCT/JP2014/050894

§ 371 (c)(1),
(2) Date: Aug. 24, 2015

(87) PCT Pub. No.: WO2014/136479

PCT Pub. Date: Sep. 12, 2014

(65) Prior Publication Data

US 2015/0376531 A1 Dec. 31, 2015

(30) Foreign Application Priority Data

Mar. 4, 2013 (JP) ..... 2013-041416

(51) Int. Cl.
*C10L 5/00* (2006.01)
*C10L 5/02* (2006.01)
(Continued)

(52) U.S. Cl.
CPC ..... *C10L 9/06* (2013.01); *C10L 2290/52* (2013.01); *C10L 2290/56* (2013.01); *C10L 2290/58* (2013.01); *C10L 2290/60* (2013.01)

(58) Field of Classification Search
CPC ..... C10L 5/00; C10L 5/02; C10L 5/34; C10L 5/36; C10L 5/366; C10L 9/00; C10L 9/02;
(Continued)

(56) References Cited

U.S. PATENT DOCUMENTS 3,723,079 A 3/1973 Seitzer
4,249,909 A 2/1981 Comolli
(Continued)

FOREIGN PATENT DOCUMENTS

AU 2011342432 6/2012
AU 2011342432 B2 6/2012
(Continued)

OTHER PUBLICATIONS

Office Action dated Jul. 4, 2016, issued in counterpart Chinese Application 201480011537.6, with English translation. (21 pages).
(Continued)

*Primary Examiner* — Natasha Young
(74) *Attorney, Agent, or Firm* — Westerman, Hattori, Daniels & Adrian, LLP

(57) ABSTRACT

The purpose is to produce inactivated coal in a short time while preventing spontaneous combustion. A coal inactivation processing apparatus for inactivating coal with an oxygen-containing process gas, wherein the coal inactivation processing apparatus comprises a kiln assembly (103) for passing coal (4) from the base-end side to the distal-end side therein, base-end-side process gas supply means (121-125) for supplying a process gas (13) to the base-end side of the interior of the kiln assembly (103), distal-end-side process gas supply means (131-135) for supplying a process gas (14) to the distal-end side of the interior of the kiln assembly (103), process gas oxygen concentration adjusting means (124*a*, 134*a*, 135, 136*a*) for adjusting the oxygen concen-
(Continued)

tration of the process gases (13, 14) supplied into the kiln assembly (103), and a cooling device (160) for cooling the coal (4) inside the kiln assembly (103).

7 Claims, 10 Drawing Sheets

(51) Int. Cl.

| | |
|---|---|
| ***C10L 5/34*** | (2006.01) |
| ***C10L 5/36*** | (2006.01) |
| ***C10L 9/00*** | (2006.01) |
| ***C10L 9/02*** | (2006.01) |
| ***C10L 9/06*** | (2006.01) |
| ***C10L 9/08*** | (2006.01) |

(58) Field of Classification Search

CPC .... C10L 9/06; C10L 9/08; C10L 9/083; C10L 2290/00; C10L 2290/02; C10L 2290/06; C10L 2290/08; C10L 2290/10; C10L 2290/143; C10L 2290/52; C10L 2290/56; C10L 2290/58; C10L 2290/60; C10B 39/00; C10B 47/00; C10B 47/28; C10B 47/30; C10B 57/00; C10B 57/005; C10B 57/08; C10B 57/10

See application file for complete search history.

(56) References Cited

U.S. PATENT DOCUMENTS

| | | | | |
|---|---|---|---|---|
| 4,402,706 | A | 9/1983 | Wunderlich | |
| 4,797,136 | A | 1/1989 | Siddoway et al. | |
| 4,828,576 | A | 5/1989 | Bixel et al. | |
| 5,035,721 | A | 7/1991 | Atherton | |
| 5,137,539 | A | 8/1992 | Bowling | |
| 5,290,523 | A | 3/1994 | Koppelman | |
| 5,324,336 | A | 6/1994 | Child | |
| 5,711,769 | A | 1/1998 | Rinker et al. | |
| 5,746,787 | A | 5/1998 | Koppelman | |
| 5,840,651 | A | 11/1998 | Hanashita et al. | |
| 5,863,304 | A | 1/1999 | Viall et al. | |
| 6,090,171 | A | 7/2000 | Viall et al. | |
| 6,146,432 | A | 11/2000 | Ochs et al. | |
| 6,436,158 | B1 | 8/2002 | Fujikawa et al. | |
| 6,878,174 | B1 | 4/2005 | Conochie | |
| 8,671,586 | B2 | 3/2014 | Bonner et al. | |
| 8,951,311 | B2 | 2/2015 | Rozelle et al. | |
| 9,290,711 | B2 | 3/2016 | Sato et al. | |
| 9,464,245 | B2 * | 10/2016 | Gao | C10B 49/10 |
| 2011/0059410 | A1 * | 3/2011 | Glynn | F02C 3/22 431/207 |
| 2011/0126743 | A1 | 6/2011 | Takase et al. | |
| 2014/0345193 | A1 | 11/2014 | Nakagawa et al. | |
| 2014/0366433 | A1 * | 12/2014 | Kaneko | A62C 3/06 44/629 |
| 2014/0373436 | A1 | 12/2014 | Nakagawa et al. | |
| 2015/0210945 | A1 | 7/2015 | Nakagawa et al. | |
| 2015/0329793 | A1 | 11/2015 | Kaneko et al. | |
| 2015/0376531 | A1 | 12/2015 | Atarashiya et al. | |

FOREIGN PATENT DOCUMENTS

| | | | |
|---|---|---|---|
| CN | 1039052 | A | 1/1990 |
| CN | 1010482 | B | 11/1990 |
| CN | 1597283 | A | 3/2005 |
| CN | 101429463 | A | 5/2009 |
| CN | 101781596 | A | 7/2010 |
| CN | 103180418 | A | 6/2013 |
| DE | 44 98 936 | T1 | 12/1995 |
| EP | 0 758 677 | A1 | 2/1997 |
| GB | 1423187 | A | 1/1976 |
| JP | 59-74189 | A | 4/1984 |
| JP | 59-227979 | A | 12/1984 |
| JP | 6065097 | A | 4/1985 |
| JP | 971791 | | 3/1997 |
| JP | 11-310785 | A | 11/1999 |
| JP | 3669373 | B2 | 7/2005 |
| JP | 2007-237011 | A | 9/2007 |
| JP | 2007-536392 | A | 12/2007 |
| JP | 2010-265394 | A | 11/2010 |
| JP | 201137938 | A | 2/2011 |
| JP | 2012-126856 | A | 7/2012 |
| JP | 2012126856 | | 7/2012 |
| JP | 2013-139536 | A | 7/2013 |
| WO | 95/13868 | A1 | 5/1995 |
| WO | 2011/016371 | A1 | 2/2011 |
| WO | WO 2012/058851 | A1 * | 5/2012 |
| WO | 2012/081371 | A1 | 6/2012 |
| WO | 2012081371 | A1 | 6/2012 |
| WO | WO 2013/103096 | A1 * | 7/2013 |

OTHER PUBLICATIONS

Japanese Notice of Allowance dated Dec. 10, 2014, issued in corresponding Japanese Japanese Applicaton No. 2012-000940; w/English translation.(6 pages).

Notification of Transmital of translation of the International Preliminary Report of the International Preliminary Report on Patentability (Chapter I or ChapterII) (Form PCT/IB/338) of the International Application No. PCT/JP2012/083230 mailed Jul. 17, 2014 with forms PCT/IB/373 and PCT/ISA/237.

Chinese Office Action dated Nov. 21, 2014, issued in corresponding Chinese Patent Application No. 201280056170.0, w/English translation (10 pages).

Office Action dated Feb. 12, 2016, issued in counterpart German Patent Application No. 11 2012 005 574.8, with English translation. (10 pages).

International Search Report dated Nov. 5, 2013, issued in corresponding application No. PCT/JP2013/076477, with forms PCT/IB/338, PCT/IB/373 and PCT/ISA/237, w/English translations.(17 pages).

Notification of Transmittal of Translation of Translation of International Preliminary Report on Patentability (Form PCT/IB/338) issued in counterpart International Application No. PCT/JP2014/050894 mailed Sep. 17, 2015 with forms PCT/IB/373, PCT/ISA/237, PCT/ISA/210, PCT/ISA/220 (12 pages).

International Search Report dated Mar. 11, 2014, issued in counterpart International Application No. PCT/JP2014/050894 (1 page).

Non-Final Office Action dated Feb. 9, 2017 issued in U.S. Appl. No. 14/408,784 (21pages).

* cited by examiner

COAL INACTIVATION PROCESSING APPARATUS

The present application is a U.S. National phase entry of International Patent Application No. PCT/JP2014/050894 filed Jan. 20, 2014 and published as WO 2014/136479, which claims foreign priority to Japanese Patent Application No. 2013-041416, filed Mar. 4, 2013, the entire contents of which are herein incorporated by reference.

TECHNICAL FIELD

The present invention relates to a coal inactivation processing apparatus.

BACKGROUND ART

Low grade coal (low rank coal) with a high moisture content such as lignite and subbituminous coal has a low calorific content per unit weight and therefore such coal is dried and pyrolyzed by heating and then modified so that the surface activity is reduced in a low oxygen atmosphere, whereby the low grade coal is turned into modified coal having a high calorific content per unit weight while preventing spontaneous combustion.

CITATION LIST

Patent Literature

Patent Document 1: Japanese Unexamined Patent Application Publication No. 2007-237011A
Patent Document 2: WO/1995/13868 Pamphlet

SUMMARY OF INVENTION

Technical Problem

Various types of coal inactivation processing apparatus for inactivating pyrolyzed coal obtained by drying and pyrolyzing low-grade coal as described above have been investigated. For example, as illustrated in FIG. 10, in a process in which coal is packed into a packed bed column from the top side and removed from the bottom side, an apparatus is used that introduces gas with an adjusted oxygen concentration into the packed bed from midway thereby bringing the gas into contact with the coal and then removes the gas so that the oxygen in the gas is adsorbed causing inactivation. An apparatus 700 of this type includes a process column 701 through which coal 721 which is pryolized coal passes from one end or the top end toward other end or the bottom end. A plurality of distal end sides of introduction pipes 711 that introduce process gas 733 containing oxygen in low concentration into the interior of the process column 701, and a plurality of base end sides of discharge pipes 712 that discharge process gas 734 that has passed through the interior of the process column 701 to the outside are each connected along the vertical direction to the process column 701. The distal end side of a supply pipe 713 that supplies the process gas 733 is connected to the base end sides of the introduction pipes 711.

The distal end side of an air supply pipe 714 that supplies air 731 and the distal end side of a nitrogen supply pipe 715 that supplies nitrogen gas 732 are connected to the base end side of the supply pipe 713. The base end side of the nitrogen supply pipe 715 is connected to a nitrogen supply source 716 such as a nitrogen gas tank or the like. The base end side of the air supply pipe 714 is open to the atmosphere. Flow rate adjustment valves 714*a*, 715*a* are provided midway on the air supply pipe 714 and the nitrogen supply pipe 715, respectively. A blower 713*a* is provided midway on the supply pipe 713. A temperature and humidity adjustment device 713*b* for adjusting the temperature and humidity of the process gas 733 is provided between the distal end side of the supply pipe 713 and the blower 713*a*. The base end side of a branch pipe 718 that discharges the process gas 733 to outside the system is connected between the blower 713*a* of the supply pipe 713 and the temperature and humidity adjustment device 713*b*. The base end side of a circulation pipe 717 is connected to the distal end sides of the discharge pipes 712. The distal end side of the circulation pipe 717 is connected to the base end side of the supply pipe 713.

In the coal inactivation processing apparatus 700, pyrolyzed coal 721 is supplied into the process column 701 from the top portion thereof, the air 731 and the nitrogen gas 732 are supplied to the supply pipe 713 from the supply pipes 714, 715 and mixed to produce the process gas 733 by controlling the lift of the flow rate adjustment valves 714*a*, 715*a* and the operation of the blower 713*a*, and the temperature and humidity of the process gas 733 are adjusted by controlling the operation of the temperature and humidity adjustment device 713*b*. The process gas 733 whose temperature and humidity has been adjusted in this way passes through the introduction pipes 711 and is introduced into the process column 701, and after inactivating the surface of the coal 721 in the interior of the process column 701, is discharged from the discharge pipes 712 into the circulation pipe 717 as used process gas 734. The used process gas 734 that is discharged into the circulation pipe 717 is returned to the supply pipe 713, is mixed with new air 731 and nitrogen gas 732 from the supply pipes 714, 715, and is reused as new process gas 733. At this time, the process gas 733 of the same quantity as the air 731 and the nitrogen gas 732 supplied from the supply pipes 714, 715 is discharged outside the system from the branch pipe 718. The process gas 733 passes through the interior of the process column 701, while the coal 721 is supplied to the interior of the process column 701 from above, so while the coal 721 is flowing from the top toward the bottom of the process column 701, oxygen is adsorbed onto the coal 721, so inactivated coal 722 is discharged from the bottom of the process column 701.

In the apparatus 700, if the oxygen concentration of the process gas 733 is increased and sudden oxygen adsorption occurs, the coal temperature within the packed bed suddenly increases and the possibility of inducing spontaneous combustion increases, so the oxygen adsorption is slowly carried out to suppress the increase in coal temperature. In order to adsorb a predetermined amount of oxygen onto the coal as described above, it was necessary to increase the dwell time of the coal within the packed bed (for example, about 14 hours), and also increase the length of the packing column (for example, 20 m×2), and this had the problems that the facility cost was increased and the process response became slow.

In light of the foregoing, the present invention has been devised to solve the above problems, and it is an object of the present invention to provide a coal inactivation processing apparatus capable of producing inactivated coal in a short time, while preventing spontaneous combustion.

Solution to Problem

The coal inactivation processing apparatus according to the first invention for solving the above problem is a coal inactivation processing apparatus that inactivates coal using process gas that contains oxygen, comprising: a kiln assembly for passing the coal from a base end side to a distal end side in the kiln assembly; base end side process gas supply means for supplying the process gas to the base end side of the interior of the kiln assembly; distal end side process gas supply means for supplying the process gas to the distal end side of the interior of the kiln assembly; process gas oxygen concentration adjusting means for adjusting the oxygen concentration of the process gas supplied to the interior of the kiln assembly; and cooling means for cooling the coal in the interior of the kiln assembly.

The coal inactivation processing apparatus according to the second invention for solving the above problem is the coal inactivation processing apparatus according to the first invention as described above, wherein the process gas oxygen concentration adjusting means includes distal end side oxygen concentration adjusting means for adjusting the oxygen concentration in the process gas supplied by the distal end side process gas supply means, and base end side oxygen concentration adjusting means for adjusting the oxygen concentration in the process gas supplied by the base end side process gas supply means to be lower than the oxygen concentration of the process gas supplied by the distal end side process gas supply means.

The coal inactivation processing apparatus according to the third invention for solving the above problem is the coal inactivation processing apparatus according to the second invention as described above, wherein the base end side oxygen concentration adjusting means adjusts the oxygen concentration of the process gas supplied by the base end side process gas supply means to be equal to or less than 12%, and the distal end side oxygen concentration adjusting means adjusts the oxygen concentration of the process gas supplied by the distal end side process gas supply means to be equal to or less than 21%.

The coal inactivation processing apparatus according to the fourth invention for solving the above problem is the coal inactivation processing apparatus according to any one of the first to third inventions as described above, further comprising humidification means for humidifying the process gas supplied to the interior of the kiln assembly.

The coal inactivation processing apparatus according to the fifth invention for solving the above problem is the coal inactivation processing apparatus according to any one of the first to fourth inventions as described above, further comprising process gas discharge means for discharging the process gas used in the interior of the kiln assembly, and circulation means for circulating the process gas discharged by the process gas discharge means to the base end side process gas supply means.

The coal inactivation processing apparatus according to the sixth invention for solving the above problem is the coal inactivation processing apparatus according to the fifth invention as described above, wherein the process gas discharge means is provided on the base end side of the kiln assembly, and includes a discharge pipe that discharges the process gas that has been used in the interior of the kiln assembly from the distal end side of the interior of the kiln assembly.

The coal inactivation processing apparatus according to the seventh invention for solving the above problem is the coal inactivation processing apparatus according to the fifth invention as described above, wherein the process gas discharge means includes base end side process gas discharge means provided on the base end side of the kiln assembly, and distal end side process gas discharge means provided on the distal end side of the kiln assembly, and the circulation means includes switching means for switching the connection between the base end side process gas discharge means and the base end side process gas supply means, and the connection between the distal end side process gas discharge means and the base end side process gas supply means.

The coal inactivation processing apparatus according to the eighth invention for solving the above problem is the coal inactivation processing apparatus according to any one of the second to seventh inventions as described above, comprising kiln assembly internal temperature measuring means for measuring the temperature of the interior of the kiln assembly, process gas oxygen concentration measuring means for measuring the oxygen concentration of the process gas supplied to the interior of the kiln assembly, and control means for controlling the process gas oxygen concentration adjusting means based on information from the kiln assembly internal temperature measuring means and the process gas oxygen concentration measuring means.

The coal inactivation processing apparatus according to the ninth invention for solving the above problem is the coal inactivation processing apparatus according to the eighth invention as described above, wherein the kiln assembly internal temperature measuring means includes base end side temperature measuring means for measuring the temperature of the interior of the base end side of the kiln assembly, the process gas oxygen concentration measuring means includes base end side oxygen concentration measuring means for measuring the oxygen concentration of the process gas supplied by the base end side process gas supply means, and the control means controls the base end side oxygen concentration measuring means based on information from the base end side temperature measuring means and the base end side oxygen concentration measuring means.

The coal inactivation processing apparatus according to the tenth invention for solving the above problem is the coal inactivation processing apparatus according to the ninth invention as described above, wherein the control means controls the base end side oxygen concentration adjusting means so that the temperature measured by the base end side temperature measuring means is equal to or less than 90° C., and, the oxygen concentration measured by the base end side oxygen concentration measuring means is equal to or less than 12%.

Advantageous Effects of Invention

According to the coal inactivation processing apparatus of the present invention, by providing the kiln assembly for passing the coal from the base end side to the distal end side therein; the base end side process gas supply means for supplying the process gas to the base end side of the interior of the kiln assembly; the distal end side process gas supply means for supplying the process gas to the distal end side of the interior of the kiln assembly; the process gas oxygen concentration adjusting means for adjusting the oxygen concentration of the process gas supplied to the interior of the kiln assembly; and the cooling means for cooling the coal in the interior of the kiln assembly, it is possible to reduce the oxygen concentration of the process gas supplied to the base end side of the kiln assembly, and increase the oxygen concentration of the process gas supplied to the distal end side of the kiln assembly compared with the oxygen concentration of the process gas supplied to the base end side, and efficiently carry out the coal inactivation process. Also, it is possible to cool the coal by the cooling means, so it is possible to prevent spontaneous combustion of the coal even though heat is generated in the inactivation process of the coal. Therefore, it is possible to greatly reduce the effort, cost, and time required for the process to suppress spontaneous combustion of the coal, and greatly increase the production efficiency. In other words, it is possible to shorten the process response and produce the modified coal in a short period of time while preventing spontaneous combustion of the coal. Also, it is possible to reduce the size of the apparatus, and greatly reduce the facility cost.

DESCRIPTION OF EMBODIMENTS

The following is a description of embodiments of the coal inactivation processing apparatus according to the present invention based on the drawings, but the present invention is not limited to only the following embodiments described based on the drawings.

First Embodiment

Figure 1:
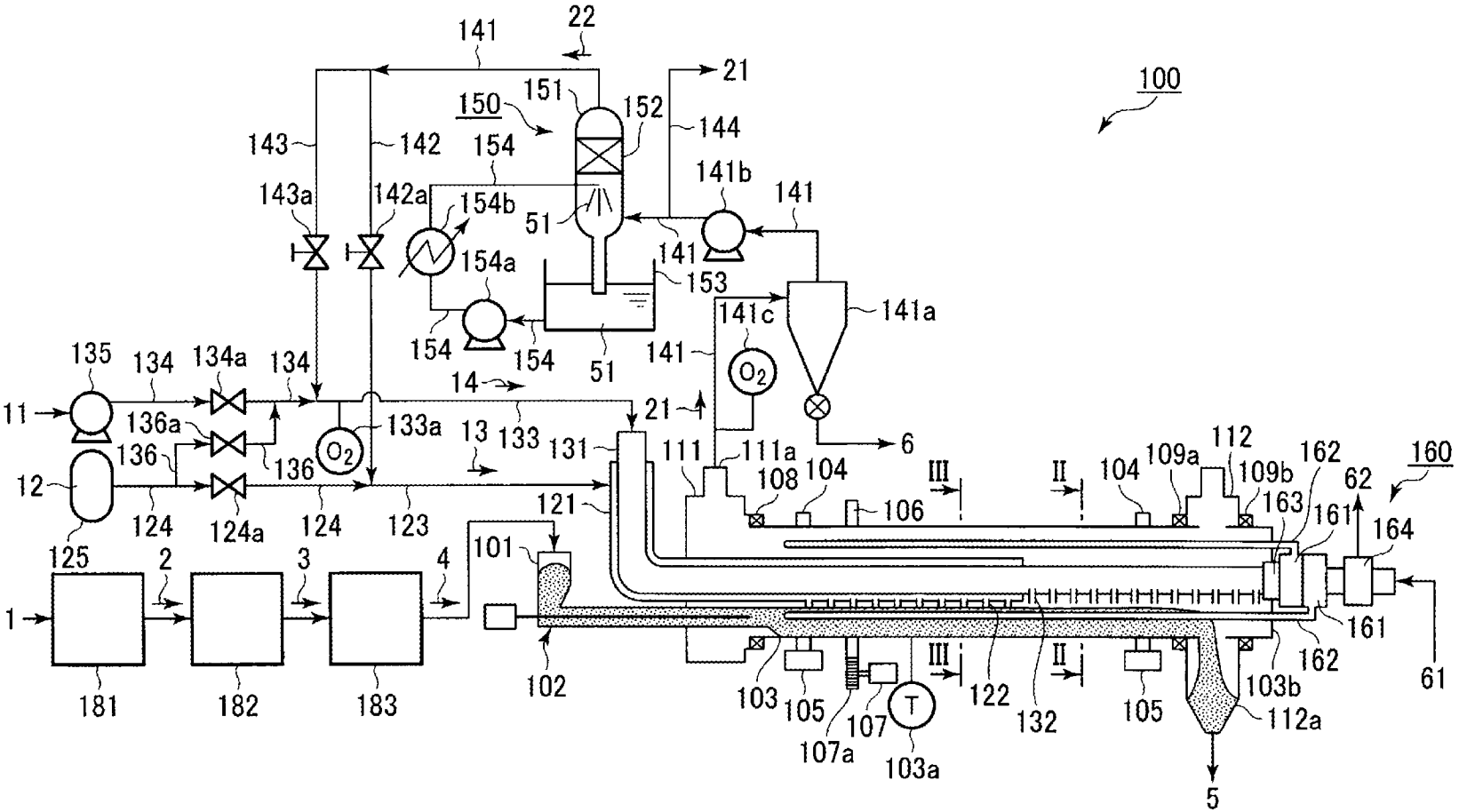
FIG. 1 is a schematic view of the configuration of the first embodiment of the coal inactivation processing apparatus according to the present invention.
Figure 2:
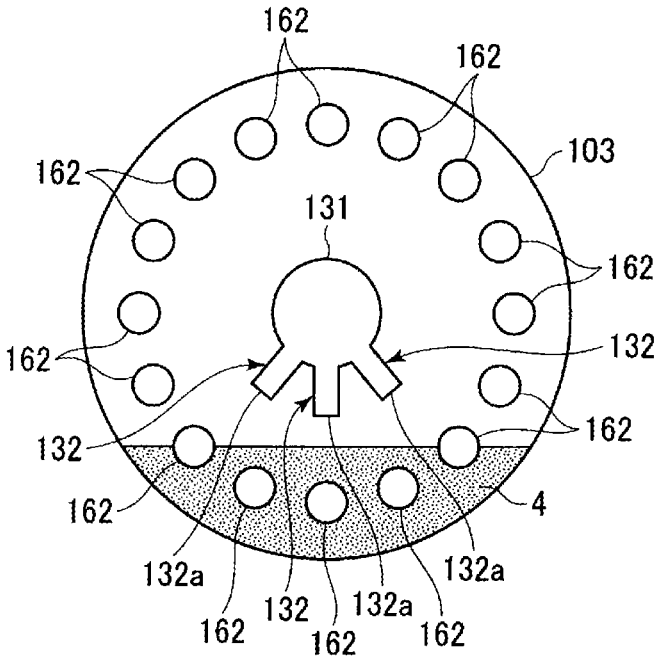
FIG. 2 is a cross-sectional view at II-II in a rotary kiln assembly provided in the coal inactivation processing apparatus.
Figure 3:
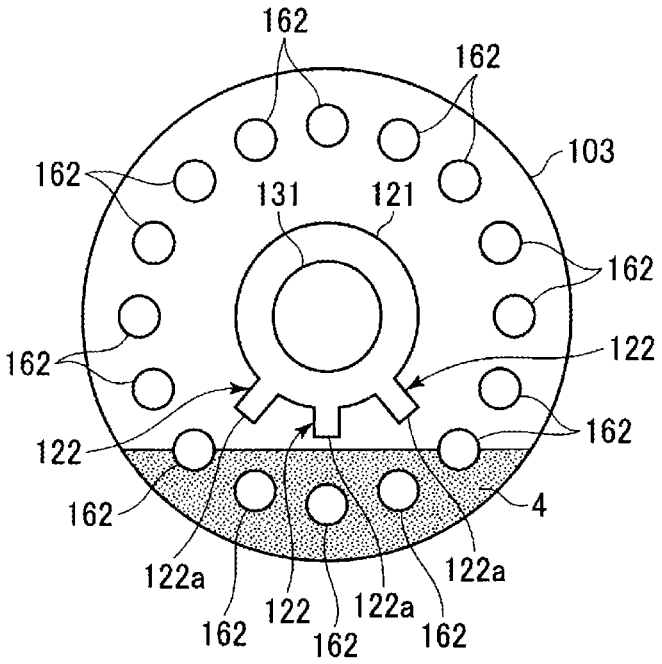
FIG. 3 is a cross-sectional view at III-III in the rotary kiln assembly provided in the coal inactivation processing apparatus.

The following is a description of the first embodiment of the coal inactivation processing apparatus according to the present invention based on FIGS. 1 to 3.

As illustrated in FIG. 1, low grade coal (low rank coal) 1 with a high water content such as lignite, subbituminous coal, or the like is supplied to the inlet of a dryer 181, which is a mesh conveyor type of drying means through which hot air (150° C. to 500° C.) is passed. The outlet of the dryer 181 is communicated with the inlet of a pyrolyzer 182, which is pyrolyzing means capable of continuously heating the interior thereof to a high temperature (300° C. to 500° C.). The outlet of the pyrolyzer 182 is communicated with the inlet of a cooler 183, which is cooling means capable of cooling the interior thereof to a lower temperature (150° C. to 200° C.). The outlet of the cooler 183 is communicated with the inlet of a hopper 101 of a coal inactivation processing apparatus 100. The outlet of the hopper 101 is communicated with the base end side of a screw feeder 102, which is rotary feeding means for feeding while rotating to the distal end side.

The distal end side of the screw feeder 102 is communicated with the base end side of a rotary kiln assembly (rotary device assembly) 103. The base end side of the rotary kiln assembly 103 is communicated with a base end side casing 111 via a seal device 108. A gas discharge outlet 111*a* that discharges used process gas 21 is provided on the top portion of the base end side casing 111. The distal end side of the rotary kiln assembly 103 is communicated with a distal end side casing 112 via seal devices 109*a*, 109*b*. A chute 112*a* that discharges the inactivated coal (modified coal) 5 downwards is provided in the bottom of the distal end side casing 112.

Ring-shaped protrusions 104 are provided on the distal end side and the base end side of the outer periphery of the rotary kiln assembly 103, and the protrusions 104 are supported by rollers 105. A gear 106 that meshes with a gear 107*a* of a drive electric motor 107 is provided on the outer periphery of the rotary kiln assembly 103. Therefore, the rotary kiln assembly 103 is rotated by the rotation of the gear 107*a* of the drive electric motor 107.

A low oxygen process gas introduction pipe 121 that introduces process gas 13 containing oxygen in low concentration (for example, 12% or less) into the interior and a high oxygen process gas introduction pipe 131 that introduces process gas 14 containing oxygen in higher concentration compared with the process gas 13 (for example, 21% or less) into the interior are provided on the rotary kiln assembly 103.

The low oxygen process gas introduction pipe 121 is coaxial with the rotary kiln assembly 103 within the rotary kiln assembly 103 and extends to substantially the center portion in the longitudinal direction of the rotary kiln assembly 103 from the base end side of the rotary kiln assembly 103. The low oxygen process gas introduction pipe 121 is fixed to the base end side casing 111, and is fixed to the high oxygen process gas introduction pipe 131. The base end side of the low oxygen process gas introduction pipe 121 is connected to the distal end side of a low oxygen process gas supply pipe 123 that supplies the process gas 13. The base end side of the low oxygen process gas supply pipe 123 is connected to an inert gas supply pipe 124 that supplies an inert gas 12 such as nitrogen gas or the like. The base end side of the inert gas supply pipe 124 is connected to an inert gas supply source 125 such as a nitrogen gas tank or the like. A flow rate adjustment valve 124*a* is provided midway on the inert gas supply pipe 124.

A plurality of jet nozzles 122 having an opening on the tip end 122*a* thereof is provided on the low oxygen process gas introduction pipe 121, as illustrated in FIGS. 1 and 3. The plurality of jet nozzles 122 is disposed adjacent to each other from the distal end side of the low oxygen process gas introduction pipe 121 to near to the protrusion 104 provided on the base end side of the rotary kiln assembly 103, and disposed adjacent to each other in the circumferential direction on the bottom side of the low oxygen process gas introduction pipe 121. The tip ends 122*a* of the jet nozzles 122 extend in the radial direction of the low oxygen process gas introduction pipe 121. In this way, the process gas 13 can be blown to the coal 4 within the rotary kiln assembly 103, and it is possible to increase the mass transfer of the oxygen in the process gas 13 into the coal 4 and increase the speed of oxygen adsorption. Note that the tip end of the low oxygen process gas introduction pipe 121 is blocked.

The high oxygen process gas introduction pipe 131 is disposed within the low oxygen process gas introduction pipe 121 from the base end side to substantially the center portion in the longitudinal direction of the rotary kiln assembly 103, and extends within the rotary kiln assembly 103 from the base end side to the distal end side of the rotary kiln assembly 103 coaxial with the rotary kiln assembly 103. The distal end side of the high oxygen process gas introduction pipe 131 is fixed to the distal end side of the rotary kiln assembly 103 via a bearing 163 of a cooling device 160 that is described in detail later. The base end side of the high oxygen process gas introduction pipe 131 is connected to the distal end side of a high oxygen process gas supply pipe 133 that supplies the process gas 14. The base end side of the high oxygen process gas supply pipe 133 is connected to the distal end side of an air supply pipe 134 that supplies air 11. A flow rate adjustment valve 134*a* and a blower 135 are provided on the air supply pipe 134 midway from the distal end side thereof. The base end side of the air supply pipe 134 is open to the atmosphere. The distal end side of a connecting pipe 136 is connected between the distal end of the air supply pipe 134 and the flow rate adjustment valve 134*a*. The base end side of the connecting pipe 136 is connected between the base end side of the inert gas supply pipe 124 and the flow rate adjustment valve 124*a*.

As illustrated in FIGS. 1 and 2, a plurality of jet nozzles 132 having an opening on the tip end 132*a* thereof is provided on the high oxygen process gas introduction pipe 131. The plurality of jet nozzles 132 is disposed adjacent to each other from the distal end side of the high oxygen process gas introduction pipe 131 to near to substantially the center portion in the longitudinal direction of the rotary kiln assembly 103, and disposed adjacent to each other in the circumferential direction on the bottom side of the high oxygen process gas introduction pipe 131. The tip ends 132*a* of the jet nozzles 132 extend in the radial direction of the high oxygen process gas introduction pipe 131. In this way, the process gas 14 can be blown to the coal 4 of the rotary kiln assembly 103, and it is possible to increase the mass transfer of the oxygen in the process gas 14 into the coal 4 and increase the speed of oxygen adsorption.

In other words, at the base end side of the rotary kiln assembly 103, it is possible to blow process gas 13 containing oxygen in low concentration (for example, 12% or less) to the coal 4 within the rotary kiln assembly 103 from the jet nozzles 122 of the low oxygen process gas introduction pipe 121, and at the distal end side of the rotary kiln assembly 103 it is possible to blow process gas 14 containing oxygen in high concentration (for example, 21% or less) from the jet nozzles 132 of the high oxygen process gas introduction pipe 131.

The gas discharge outlet 111*a* of the base end side casing 111 is connected to the base end side of a circulation pipe 141. A cyclone 141*a*, a blower 141*b*, and a temperature and humidity adjustment device 150 are provided midway on the circulation pipe 141 in that order from the base end side thereof. The base end side of an air discharge pipe 144 is connected between the blower 141*b* and the temperature and humidity adjustment device 150 on the circulation pipe 141.

The temperature and humidity adjustment device 150 includes a process column 151 filled with packing material 152. A water storage tank 153 that stores water 51 for adjustment of temperature and humidity is disposed below the process column 151. The base end side of a water supply pipe 154 is connected to the water storage tank 153. The distal end side of the water supply pipe 154 is located below the packing material 152 within the process column 151. A blower 154*a* and a diffuser 154*b* are provided midway on the water supply pipe 154, to enable water 51 whose temperature has been adjusted to be injected from the distal end side of the water supply pipe 154. In this way, the process gas 21 becomes temperature and humidity-adjusted process gas 22 whose temperature and humidity have been adjusted by heating and humidifying (for example, saturated at 50° C.), so that even at, for example 90° C., the relative humidity is 35% or higher.

The distal end side of the circulation pipe 141 is connected to the base end side of branch circulation pipes 142, 143. Flow rate adjustment valves 142*a*, 143*a* are provided midway on the branch circulation pipes 142, 143 respectively. The distal end side of the branch circulation pipe 142 is connected to the base end side of the low oxygen process gas supply pipe 123. The distal end side of the branch circulation pipe 143 is connected to the base end side of the high oxygen process gas supply pipe 133.

The cooling device 160 is fixed to a side wall portion 103*b* of the distal end side of the rotary kiln assembly 103 via the bearing 163. The cooling device 160 is provided on the bearing 163 and includes a cooling water supply header 161 that supplies cooling water 61 from outside the system. A plurality of supply pipes 162 that supply the cooling water 61 are connected to the cooling water supply header 161. The supply pipes 162 are arranged penetrating the side wall portion 103*b* of the rotary kiln assembly 103. In this way, the plurality of supply pipes 162 rotates together with the rotation of the rotary kiln assembly 103. As illustrated in FIGS. 1 to 3, the plurality of supply pipes 162 is disposed within the rotary kiln assembly 103 adjacent in the peripheral direction of the rotary kiln assembly 103. The plurality of supply pipes 162 extend within the rotary kiln assembly 103 parallel to the axial center of the rotary kiln assembly 103, and extend from the distal end side of the rotary kiln assembly 103 toward the base end side of the rotary kiln assembly 103 further than the jet nozzles 122 provided on the base end side of the low oxygen process gas introduction pipe 121. In this way, in the region where the activation process is carried out on the coal 4 by the process gas 13, 14 injected from the jet nozzles 122, 132, the coal 4 is adjusted to a temperature at which spontaneous combustion does not occur by the cooling water 61 passing through the supply pipes 162. The cooling device 160 includes a cooling water discharge header 164 that discharges to outside the system the used cooling water 62 that has passed through the supply pipes 162.

A temperature sensor 103*a* that measures the temperature of the coal 4 in the interior is provided within a range substantially in the center portion in the longitudinal direction from the base end side of the rotary kiln assembly 103. An oxygen sensor 133*a* that measures the oxygen concentration of the process gas 14 passing through the high oxygen process gas supply pipe 133 is provided midway on the high oxygen process gas supply pipe 133. An oxygen sensor 141*c* that measures the oxygen concentration of the used process gas 21 that passes through the circulation pipe 141 is provided between the base end side of the circulation pipe 141 and the cyclone 141*a*.

In the present embodiment as described above, base end side oxygen concentration adjusting means is configured from the flow rate adjustment valve 124*a*, the flow rate adjustment valve 142*a*, the blower 141*b*, and the like. Distal end side oxygen concentration adjusting means is configured from the flow rate adjustment valve 134*a*, the blower 135, a flow rate adjustment valve 136*a*, the flow rate adjustment valve 143*a*, the blower 141*b*, and the like. The process gas oxygen concentration adjusting means is configured from the base end side oxygen concentration adjusting means, the distal end side oxygen concentration adjusting means, and the like. Humidification means is configured from the temperature and humidity adjustment device 150 and the like. Circulation means is configured from the circulation pipe 141, the cyclone 141*a*, the blower 141*b*, the humidification means, the branch circulation pipe 142, the flow rate adjustment valve 142*a*, the branch circulation pipe 143, the flow rate adjustment valve 143*a*, the air discharge pipe 144, and the like. The base end side process gas supply means is configured from the low oxygen process gas introduction pipe 121, the jet nozzles 122, the low oxygen process gas supply pipe 123, the inert gas supply pipe 124, the inert gas supply source 125, the circulation means, the base end side oxygen concentration adjusting means, and the like. The distal end side process gas supply means is configured from the high oxygen process gas introduction pipe 131, the jet nozzles 132, the high oxygen process gas supply pipe 133, the air supply pipe 134, the connecting pipe 136, the inert gas supply pipe 124, the inert gas supply source 125, the circulation means, the distal end side oxygen concentration adjusting means, and the like. Cooling means is configured from the cooling device 160 and the like. Rotating means is configured from the protrusions 104, the rollers 105, the gear 106, the drive electric motor 107, the gear 107*a*, and the like. Coal supply means is configured from the hopper 101, the screw feeder 102, and the like. Coal discharge means is configured from the distal end side casing 112, the chute 112*a*, and the like. Process gas discharge means and base end side process gas discharge means are configured from the base end side casing 111, the gas discharge outlet 111*a*, and the like. Kiln assembly internal temperature measuring means and base end side temperature measuring means are configured from the temperature sensor 103*a* and the like. Process gas oxygen concentration measuring means and base end side oxygen concentration measuring means are configured from the oxygen sensor 141*c* and the like. The coal inactivation processing apparatus 100 is configured from each of the means, the rotary kiln assembly 103, the seal devices 108, 109*a*, 109*b*, and the like.

The following is a description of a coal inactivation processing method for inactivating low rank coal 1 using the coal inactivation processing apparatus 100 according to the present embodiment configured in this way.

When the low rank coal 1 is supplied to the dryer 181, the low rank coal 1 is dried by the hot air (150° C. to 500° C.), and virtually all the water content is removed to produce dried coal 2 (water content about 0%). The dried coal 2 is supplied to the pyrolyzer 182, and is pyrolyzed by heating (300° C. to 500° C.), so the volatile components are separated and removed in the form of gas, and the oily component is separated and removed as tar, to produce pyrolyzed coal 3. The pyrolyzed coal 3 is supplied to the cooler 183, and cooled (150° C. to 200° C.), to become cooled coal 4. The coal 4 is supplied to the hopper 101, and fed to the rotary kiln assembly 103 by the screw feeder 102.

By controlling the lift of the flow rate adjustment valve 124*a*, the inert gas 12 within the inert gas supply source 125 is supplied to the low oxygen process gas supply pipe 123 via the inert gas supply pipe 124, and by controlling the lift of the flow rate adjustment valve 142*a* and the operation of the blower 141*b*, process gas 22 is supplied to the low oxygen process gas supply pipe 123 via the circulation pipe 141 and the branch circulation pipe 142. In this way, the inert gas 12 and the process gas 22 are mixed to produce the process gas 13 containing oxygen in low concentration. The process gas 13 is introduced into the rotary kiln assembly 103 via the low oxygen process gas introduction pipe 121, and injected to the coal 4 within the rotary kiln assembly 103 from the jet nozzles 122 from the base end side of the rotary kiln assembly 103 to substantially the center portion in the longitudinal direction thereof.

On the other hand, by controlling the lift of the flow rate adjustment valve 134*a* and the operation of the blower 135, air is supplied to the high oxygen process gas supply pipe 133 via the air supply pipe 134, and by controlling the lift of the flow rate adjustment valve 136*a*, the inert gas 12 within the inert gas supply source 125 is supplied to the high oxygen process gas supply pipe 133 via the inert gas supply pipe 124, the connecting pipe 136, and the air supply pipe 134, and by controlling the lift of the flow rate adjustment valve 143*a* and the operation of the blower 141*b*, the process gas 22 is supplied to the high oxygen process gas supply pipe 133 via the circulation pipe 141 and the branch circulation pipe 143. In this way, the air 11, the inert gas 12, and the process gas 22 are mixed to produce the process gas 14 containing oxygen in high concentration. The process gas 14 is introduced into the rotary kiln assembly 103 via the high oxygen process gas introduction pipe 131, and is injected to the coal 4 within the rotary kiln assembly 103 by the jet nozzles 132 from substantially the center portion in the longitudinal direction of the rotary kiln assembly 103 to the distal end side thereof.

The gear 107*a* of the drive electric motor 107 is rotated, and the rotary kiln assembly 103 is rotated by this rotation transmitted via the gear 106. As the rotary kiln assembly 103 is rotated, the coal 4 fed into the rotary kiln assembly 103 moves from the base end side to the distal end side of the rotary kiln assembly 103 while being agitated. The coal 4 within the rotary kiln assembly 103 adsorbs the oxygen of the process gas 13 injected from the jet nozzles 122 from the base end side to substantially the center portion in the longitudinal direction of the rotary kiln assembly 103, thereby causing a hydration reaction. The coal 4 within the rotary kiln assembly 103 adsorbs the oxygen of the process gas 14 injected from the jet nozzles 132 from substantially the center portion in the longitudinal direction to the distal end side of the rotary kiln assembly 103, thereby causing a hydration reaction. The inactivation process by the oxygen adsorption and hydration reaction in this way produces modified coal 5, which is transported outside the system via the chute 112*a*. Although heat is generated by the oxygen adsorption and the hydration reaction of the process gas 13, 14 on the coal 4 within the rotary kiln assembly 103, the coal 4 is adjusted to a temperature at which spontaneous combustion does not occur by the cooling water 51 passing through the supply pipes 162.

The used process gas 21 that was used in the process of inactivating the coal 4 within the rotary kiln assembly 103 is passed in a direction opposite to the transport direction of the coal 4, and flows into the circulation pipe 141 from the gas discharge outlet 111*a* of the base end side casing 111 provided at the base end side of the rotary kiln assembly 103. The process gas 14 injected from the jet nozzles 132 flows to the base end side of the rotary kiln assembly 103 after it has been used for oxygen adsorption and the hydration reaction of the coal 4, and is also used for oxygen adsorption and the hydration reaction of the coal 4 from the base end side to substantially the center portion in the longitudinal direction of the rotary kiln assembly 103, so rapid inactivation is carried out.

Pulverized coal 6 contained in process gas 21 that has flowed to the circulation pipe 141 is removed from the process gas 21 by the cyclone 141*a*, a portion of the process gas 21 is discharged to outside the system via the air discharge pipe 144, and the remainder is adjusted for temperature and humidity by the temperature and humidity adjustment device 150 to produce the temperature and humidity adjusted process gas 22. By controlling the lift of the flow rate adjustment valve 142*a*, the process gas 22 is supplied to the low oxygen process gas supply pipe 123 via the branch circulation pipe 142 and circulated, and by controlling the lift of the flow rate adjustment valve 143*a*, is supplied to the high oxygen process gas supply pipe 133 via the branch circulation pipe 143 and circulated.

In other words, in the present embodiment, coal 4 that has been dried, pyrolyzed, and cooled is transported within the rotary kiln assembly 103. The temperature of the coal 4 is adjusted by the cooling water 61 flowing within the supply pipes 162 from the distal end side to the base end side of the rotary kiln assembly 103, while being agitated by the rotary kiln assembly 103, in the range from the base end side to substantially the center portion in the longitudinal direction of the rotary kiln assembly 103, in other words, in the upstream side of the rotary kiln assembly 103, oxygen adsorption and the hydration reaction occurs with the process gas 13 containing oxygen in low concentration. Next, in the region from substantially the center portion in the longitudinal direction to the distal end side of the rotary kiln assembly 103, in other words, in the downstream side of the rotary kiln assembly 103, oxygen adsorption and the hydration reaction occurs with the process gas 14 containing oxygen in high concentration.

Therefore, in the present embodiment, it is possible to achieve rapid oxidation reaction (adsorption of oxygen by the coal 4), while preventing spontaneous combustion.

Therefore, according to the present embodiment, it is possible to greatly reduce the time and cost required for the process to suppress spontaneous combustion of the coal 4 (approximately 1 hour), and greatly improve the production efficiency. In other words, it is possible to shorten the process response and produce modified coal 5 in a short period of time, while preventing spontaneous combustion of the coal 4. Also, it is possible to reduce the size of the apparatus (for example, about 5 m), and greatly reduce the cost of the apparatus.

Also, the used process gas 21 that was used for oxygen adsorption and the hydration reaction of the coal 4 within the rotary kiln assembly 103 is circulated to the low oxygen process gas supply pipe 123 and the high oxygen process gas supply pipe 133 via the circulation pipe 141 and the branch circulation pipes 142, 143, so it is possible to effectively use the process gas 21. Also, by adjusting the quantity of the used process gas 21 circulated to the process gas 13, it is possible to adjust the oxygen concentration of the process gas 13.

In addition, the coal 4 within the rotary kiln assembly 103 is adjusted to a temperature at which spontaneous combustion does not occur by the cooling water 61 flowing within the supply pipes 162, and the temperature and humidity adjusted process gas 22 is produced by adjusting the temperature and humidity of the process gas 21 by the temperature and humidity adjustment device 150 provided on the circulation pipe 141. The process gas 22 is circulated to the low oxygen process gas supply pipe 123 and the high oxygen process gas supply pipe 133 via the circulation pipe 141 and the branch circulation pipes 142, 143, so it is possible to simultaneously perform the inactivation process by oxygen adsorption and the hydration process, while preventing spontaneous combustion of the coal 4 transported within the rotary kiln assembly 103. In this way, conventionally the hydration process was performed on the coal by a hydration processing apparatus that was provided separately from the coal inactivation processing apparatus, but this hydration processing apparatus becomes unnecessary, so it is possible to reduce the processing time and reduce the processing cost. In other words, the process gas 13, 14 whose oxygen concentration and humidity has been adjusted is supplied within the rotary kiln assembly 103 having the supply pipes 162, and the hydration reaction by adsorption of water vapor is carried out simultaneously with the inactivation of the coal 4 by oxygen adsorption, and the heat of reaction generated by the inactivation and the hydration reaction is simultaneously removed, so it is possible to rapidly carry out the inactivation process and the hydration process while controlling the temperature of the coal 4 and reliably suppressing the spontaneous combustion.

Second Embodiment

Figure 4:
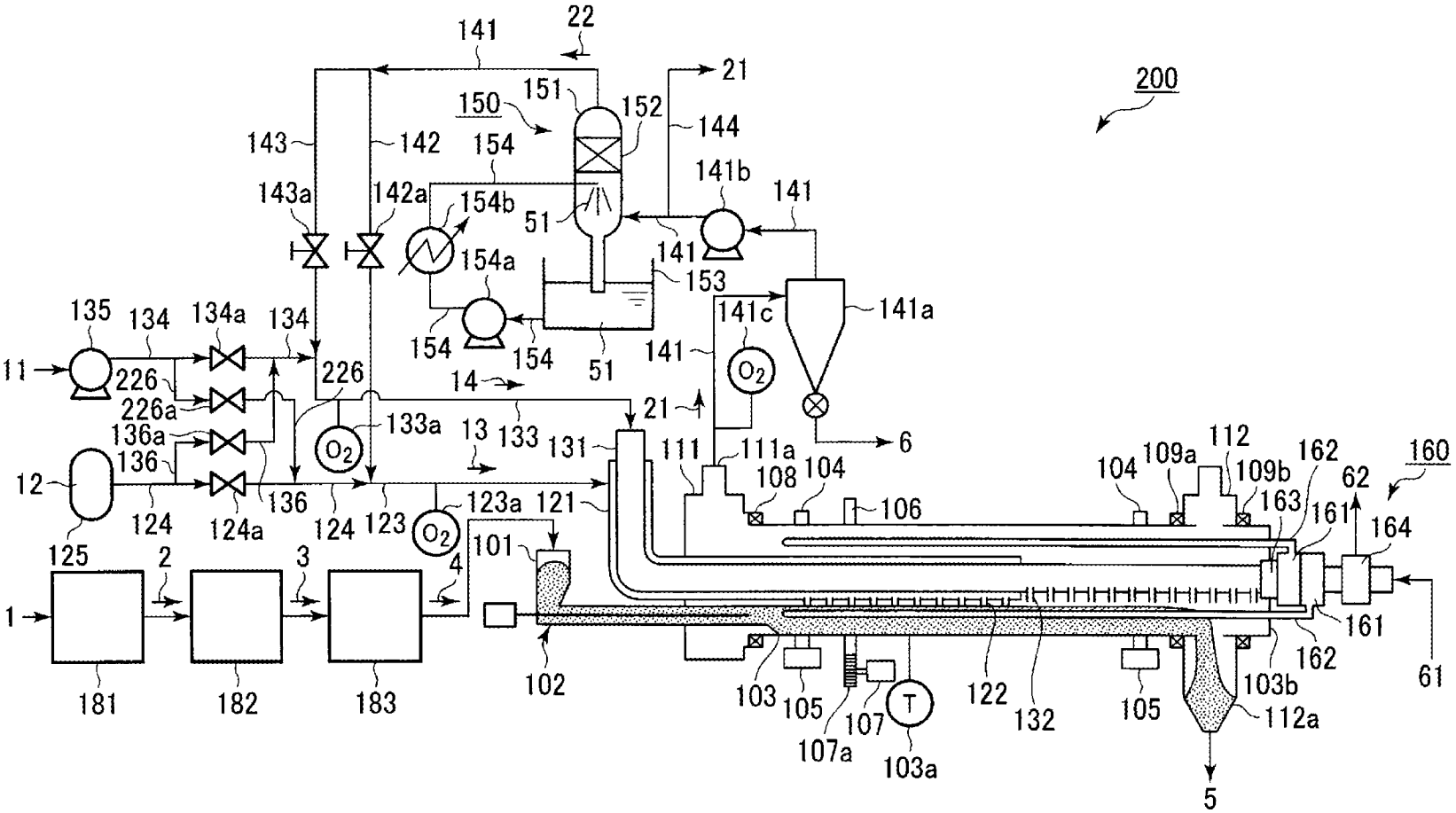
FIG. 4 is a schematic view of the configuration of a second embodiment of the coal inactivation processing apparatus according to the present invention.

The following is a description of a second embodiment of the coal inactivation processing apparatus according to the present invention based on FIG. 4.

The present embodiment is configured by adding a connecting pipe that supplies air to the low oxygen process gas supply pipe provided in the first embodiment as described above and illustrated in FIG. 1. The rest of the configuration is generally the same as that described above and illustrated in FIG. 1, so the same equipment is given the same reference numeral and duplicated descriptions are omitted as appropriate.

As illustrated in FIG. 4, a coal inactivation processing apparatus 200 according to the present embodiment includes a connecting pipe 226 connected at the distal end side thereof between the distal end side of the inert gas supply pipe 124 and the flow rate adjustment valve 124*a*. The base end side of the connecting pipe 226 is connected between the flow rate adjustment valve 134*a* and the blower 135 on the air supply pipe 134. A flow rate adjustment valve 226*a* is provided midway on the connecting pipe 226. An oxygen sensor 123*a* that measures the oxygen concentration of the process gas 13 flowing in the low oxygen process gas supply pipe 123 is provided midway on the low oxygen process gas supply pipe 123.

In the present embodiment, the base end side oxygen concentration adjusting means is configured from similar equipment as the first embodiment as described above, the flow rate adjustment valve 226*a*, the blower 135, and the like. The process gas oxygen concentration adjusting means and the coal inactivation processing apparatus 200 are configured from similar equipment as the first embodiment as described above, the base end side oxygen concentration adjusting means, and the like. Process gas oxygen concentration measuring means and base end side oxygen concentration measuring means are configured from the oxygen sensor 123*a* and the like. The other means are configured from similar equipment as the first embodiment described above.

In the coal inactivation processing apparatus 200 according to the present embodiment that includes the connecting pipe 226 and the flow rate adjustment valve 226*a*, it is possible to produce the modified coal 5 from the low rank coal 1 by causing the same central operation as for the coal inactivation processing apparatus 100 according to the first embodiment as described previously.

Also, by controlling the lift of the flow rate adjustment valve 124*a* and controlling the lift of the flow rate adjustment valve 226*a* and the operation of the blower 135, the process gas 13 formed by mixing the inert gas 12 within the inert gas supply source 125 and the air 11 can be supplied to the low oxygen process gas supply pipe 123, even when starting operation. In other words, even when starting operation, it is possible for the process gas 13 to include oxygen.

Therefore, according to the present embodiment, it is possible to adjust the oxygen concentration of the process gas 13 injected into the upstream side of the rotary kiln assembly 103 from the start of operation, so it is possible to rapidly carry out the inactivation process on the coal 4 and reduce the processing time compared with the coal inactivation processing apparatus 100 according to the first embodiment as described above that does not include the connecting pipe 226 and the flow rate adjustment valve 226*a* that delivers the air 11 flowing in the air supply pipe 134 to the low oxygen process gas supply pipe 123.

Third Embodiment

Figure 5:
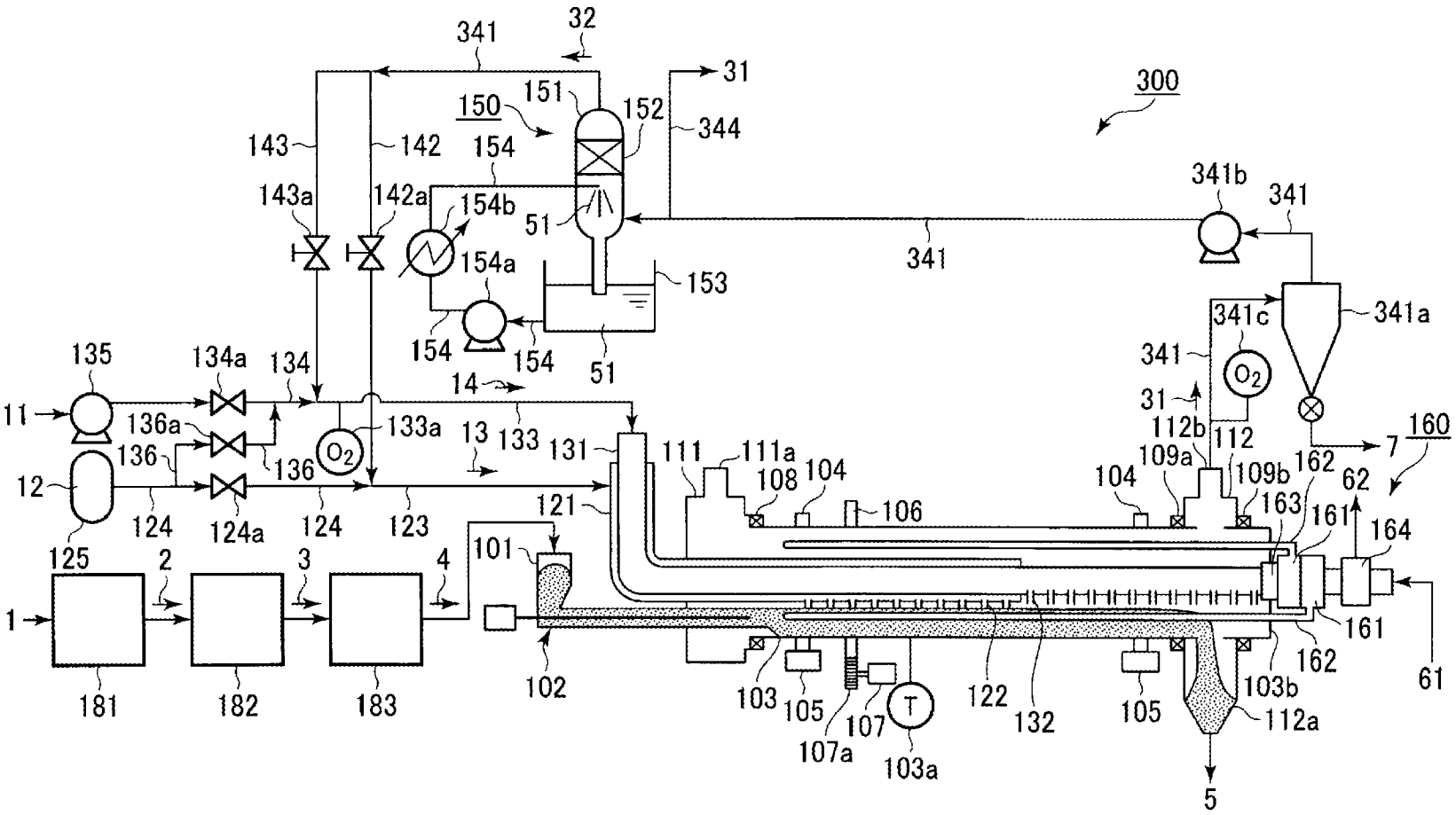
FIG. 5 is a schematic view of the configuration of a third embodiment of the coal inactivation processing apparatus according to the present invention.

The following is a description of a third embodiment of the coal inactivation processing apparatus according to the present invention based on FIG. 5.

The present embodiment is configured by modifying the gas discharge outlet and the circulation pipe provided in the first embodiment as described above and illustrated in FIG. 1. The rest of the configuration is generally the same as that described above and illustrated in FIG. 1, so the same equipment is given the same reference numeral and duplicated descriptions are omitted as appropriate.

As illustrated in FIG. 5, a coal inactivation processing apparatus 300 according to the present embodiment includes a distal end side casing 112, disposed on the distal end side of the rotary kiln assembly 103, on which a gas discharge outlet 112*b*, which discharges used process gas 31 that was used in the inactivation process of the coal 4 within the rotary kiln assembly 103, is provided. The gas discharge outlet 112*b* is connected to the base end side of a circulation pipe 341 that circulates process gas 31. The distal end side of the circulation pipe 341 is connected to the base end side of the branch circulation pipes 142, 143.

A cyclone 341*a*, a blower 341*b*, and the temperature and humidity adjustment device 150 are provided on the circulation pipe 341 from the base end side. The base end side of an air discharge pipe 344 is connected between the blower 341*b* and the temperature and humidity adjustment device 150 on the circulation pipe 341. Note that an oxygen sensor 341*c* that measures the oxygen concentration of the process gas 31 flowing within the circulation pipe 341 is provided between the base end side of the circulation pipe 341 and the cyclone 341*a*.

In the present embodiment, the process gas discharge means and the distal end side process gas discharge means are configured from the distal end side casing 112, the gas discharge outlet 112*b*, and the like. The base end side oxygen concentration adjusting means is configured from similar equipment as the first embodiment as described above except that the blower 341*b* is provided instead of the blower 141*b* included in the first embodiment. The distal end side oxygen concentration adjusting means is configured from similar equipment as the first embodiment as described above except that the blower 341*b* is provided instead of the blower 141*b* included in the first embodiment. The process gas oxygen concentration adjusting means is configured from the base end side oxygen concentration adjusting means, the distal end side oxygen concentration adjusting means, and the like. The circulation means is configured from similar equipment as in the first embodiment as described above except that the circulation pipe 341, the cyclone 341*a*, and the blower 341*b* are provided instead of the circulation pipe 141, the cyclone 141*a*, and the blower 141*b* provided in the first embodiment as described above, and the like. The base end side process gas supply means is configured from the circulation means, the base end side oxygen concentration adjusting means, and otherwise similar equipment as the first embodiment as described above, and the like. The distal end side process gas supply means is configured from the circulation means, the distal end side oxygen concentration adjusting means, and otherwise similar equipment as the first embodiment as described above, and the like. The coal inactivation processing apparatus 300 is configured from the process gas discharge means, the process gas oxygen concentration adjusting means, the circulation means, the base end side process gas supply means, the distal end side process gas supply means, and otherwise similar equipment as the first embodiment as described above, and the like. The other means are configured from similar equipment as the first embodiment described above.

In the coal inactivation processing apparatus 300 according to the present embodiment that includes the gas discharge outlet 112*b*, the circulation pipe 341, the cyclone 341*a*, and the blower 341*b*, it is possible to produce the modified coal 5 from the low rank coal 1 by causing the same central operation as for the coal inactivation processing apparatus 100 according to the first embodiment as described above.

The process gas 13 injected from the jet nozzles 122 and the process gas 14 injected from the jet nozzles 132 are used in the inactivation process of the coal 4 within the rotary kiln assembly 103 and becomes the used process gas 31. The process gas 31 flows in the same direction as the direction of transport of the coal 4, and flows into the circulation pipe 341 from the gas discharge outlet 112*b* of the distal end side casing 112 provided on the distal end side of the rotary kiln assembly 103. After being used in the oxygen adsorption and hydration reaction of the coal 4, the process gas 13 injected from the jet nozzles 122 flows toward the distal end side of the rotary kiln assembly 103, but it contains oxygen in lower concentration than the quantity necessary for oxygen adsorption of the coal 4 from the center portion in the longitudinal direction to the distal end side of the rotary kiln assembly 103. Therefore, the inactivation process of the coal 4 is not promoted by the used process gas 31, so the inactivation process progresses gently, so it is possible to stably carry out the inactivation process of the coal 4.

Pulverized coal 7 contained in process gas 31 that has flowed to the circulation pipe 341 is removed from the process gas 31 by the cyclone 341*a*, a portion of the process gas 31 is discharged to outside the system via the air discharge pipe 344, and the remainder is adjusted for temperature and humidity by the temperature and humidity adjustment device 150 to produce temperature and humidity adjusted process gas 32. By controlling the lift of the flow rate adjustment valve 142*a*, the process gas 32 is supplied to the low oxygen process gas supply pipe 123 via the branch circulation pipe 142 and circulated. On the other hand by controlling the lift of the flow rate adjustment valve 143*a*, the process gas 32 is supplied to the high oxygen process gas supply pipe 133 via the branch circulation pipe 143 and circulated.

Therefore, according to the present embodiment, after the process gas 13, 14 injected from the jet nozzles 122, 132 is used for oxygen adsorption of the coal 4, it flows in the same direction as the direction of transport of the coal 4, so the inactivation process proceeds gently, and it is possible to stably carry out the inactivation process of the coal 4.

Fourth Embodiment

Figure 6:
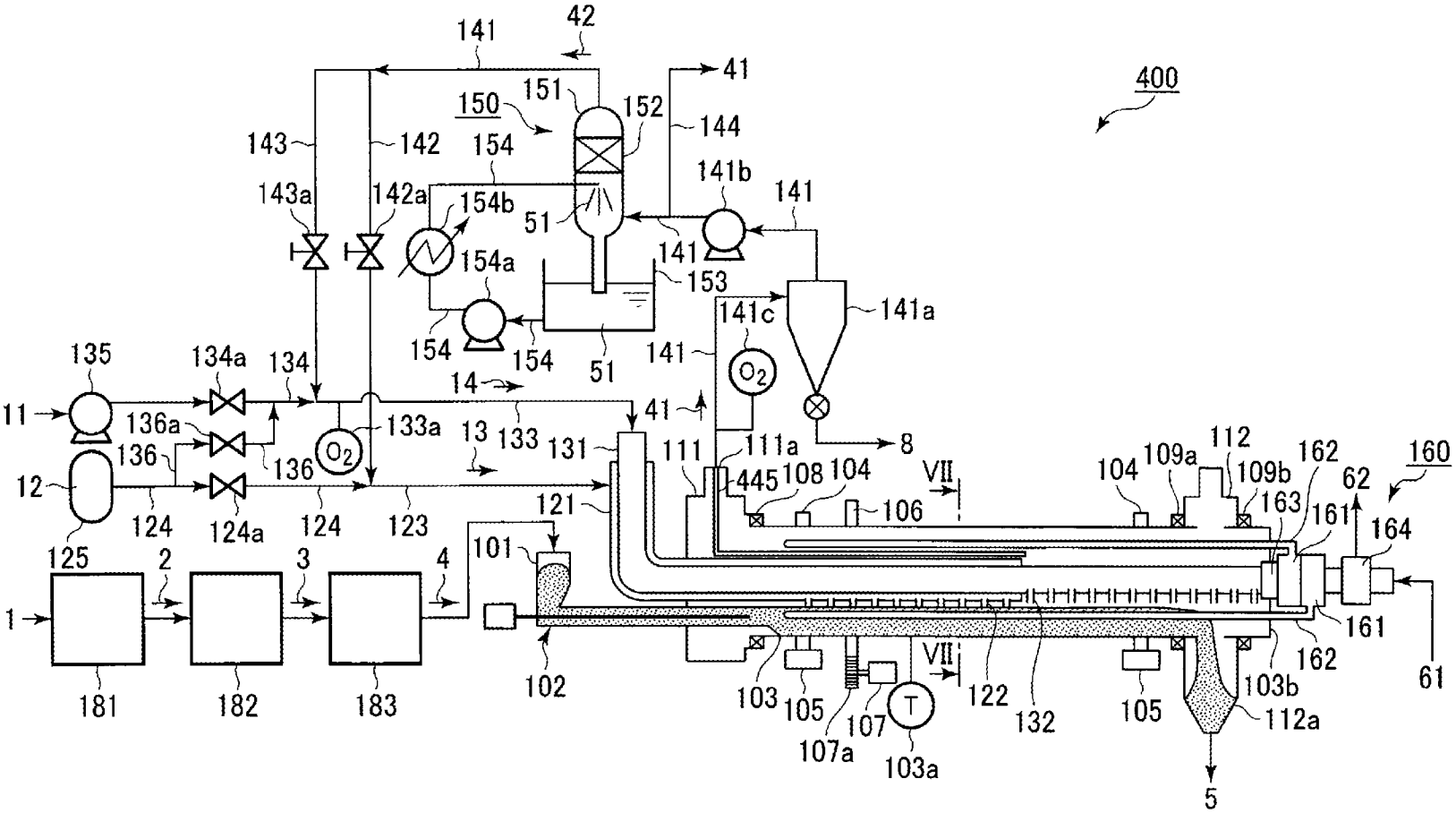
FIG. 6 is a schematic view of the configuration of a fourth embodiment of the coal inactivation processing apparatus according to the present invention.
Figure 7:
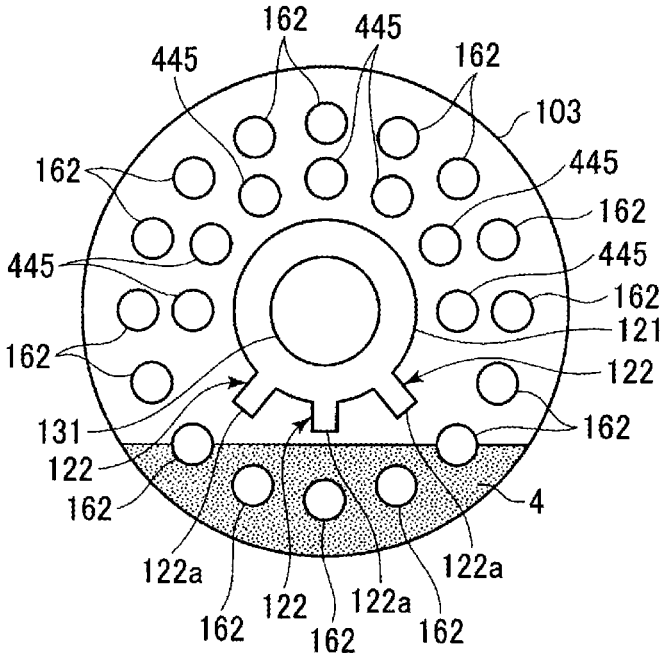
FIG. 7 is a cross-sectional view at VII-VII in the rotary kiln assembly provided in the coal inactivation processing apparatus.

The following is a description of a fourth embodiment of the coal inactivation processing apparatus according to the present invention based on FIGS. 6 and 7.

The present embodiment is configured by adding a discharge pipe to the base end side of the circulation pipe provided in the first embodiment as described above and illustrated in FIG. 1. The rest of the configuration is generally the same as that described above and illustrated in FIG. 1, so the same equipment is given the same reference numeral and duplicated descriptions are omitted as appropriate.

As illustrated in FIGS. 6 and 7, a coal inactivation processing apparatus 400 according to the present embodiment includes a plurality of discharge pipes 445 connected to the base end side of the circulation pipe 141 and extending along the base end side casing ill and the rotary kiln assembly 103. The plurality of discharge pipes 445 extend in the vertical direction and at the bottom end side thereof extend in the horizontal direction within the base end side casing 111. The plurality of discharge pipes 445 is disposed within the rotary kiln assembly 103 adjacent to each other in the peripheral direction of the rotary kiln assembly 103, and is disposed between the supply pipes 162 and the low oxygen process gas introduction pipe 121. The distal ends of the discharge pipes 445 are open, and positioned in a location opposite in the radial direction to the jet nozzles 132 of the base end side of the high oxygen process gas introduction pipe 131.

In the present embodiment, the process gas discharge means and the base end side process gas discharge means are configured from the equipment included in the first embodiment as described above, the discharge pipes 445, and the like. The coal inactivation processing apparatus 400 is configured from the process gas discharge means, and otherwise similar equipment as the first embodiment as described above, and the like. The other means are configured from similar equipment as the first embodiment described above.

In the coal inactivation processing apparatus 400 according to the present embodiment that includes the discharge pipes 445, it is possible to produce the modified coal 5 from the low rank coal 1 by causing the same central operation as for the coal inactivation processing apparatus 100 according to the first embodiment as described previously.

Also, the process gas 14 injected from the jet nozzles 132 flows to the discharge pipes 445 and the circulation pipe 141 after it has been used for the oxygen adsorption and the hydration reaction of the coal 4. In this way, the process gas 14 is not used for oxygen adsorption and the hydration reaction of the coal 4 from the base end side to substantially the center portion in the longitudinal direction of the rotary kiln assembly 103, so the inactivation process proceeds gently, and it is possible to stably carry out the inactivation process of the coal 4.

Therefore, according to the present embodiment, the discharge pipes 445 are provided within the rotary kiln assembly 103, and the distal ends of the discharge pipes 445 are located substantially in the center portion in the longitudinal direction of the rotary kiln assembly 103. On the other hand, by connecting the base end side to the base end side of the circulation pipe 141, it is possible for the process gas 14 injected from the jet nozzles 132 to flow through the discharge pipes 445 to the circulation pipe 141 after being used in the inactivation process of the coal 4, so the inactivation process proceeds gently, and it is possible to stably carry out inactivation of the coal 4.

Fifth Embodiment

Figure 8:
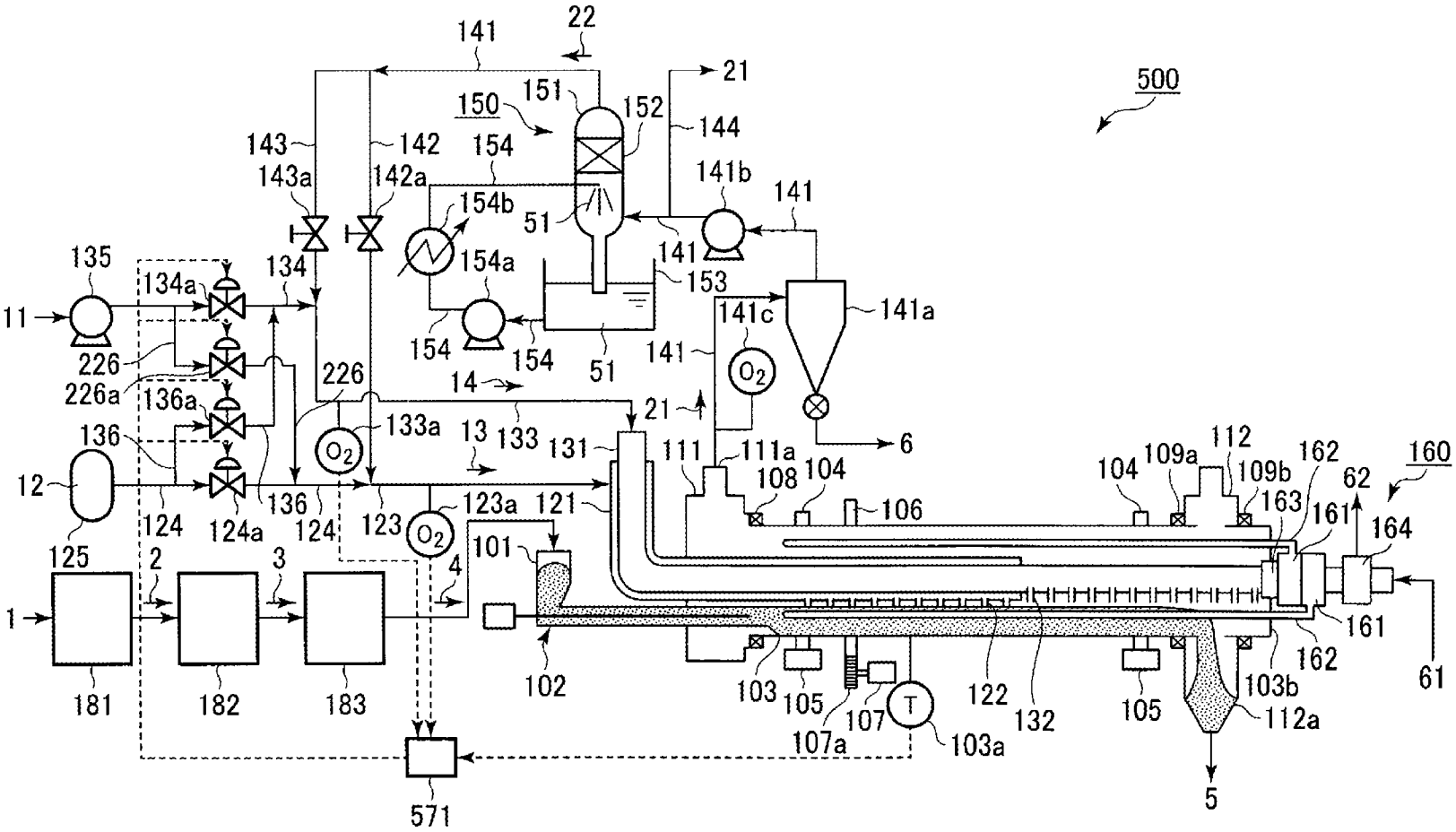
FIG. 8 is a schematic view of the configuration of the fifth embodiment of the coal inactivation processing apparatus according to the present invention.

The following is a description of a fifth embodiment of the coal inactivation processing apparatus according to the present invention based on FIG. 8.

The present embodiment is configured by adding a control device that controls the flow rate adjustment valve provided in the second embodiment as described above and illustrated in FIG. 4. The rest of the configuration is generally the same as that described above and illustrated in FIG. 4, so the same equipment is given the same reference and duplicated descriptions are omitted as appropriate.

As illustrated in FIG. 8, a coal inactivation processing apparatus 500 according to the present embodiment includes a control device 571 connected to the output side of the temperature sensor 103*a*, the oxygen sensors 123*a*, 133*a*, as well as to the input side of the flow rate adjustment valves 124*a*, 134*a*, 136*a*, 226*a*. The control device 571 is also connected to the output side of the oxygen sensor 141*c*, the input side of the blowers 135, 141*b*, 154*a*, the input side of the diffuser 154*b*, and the input side of the flow rate adjustment valves 142*a*, 143*a*.

The control device 571 controls the lift of the flow rate control valves 124*a*, 142*a*, 226*a* and the operation of the blowers 135, 141*b*, 154*a* so that the temperature T measured by the temperature sensor 103*a* is equal to or less than a predetermined temperature Y, for example, 90° C. Also, the control device 571 controls the lift of the flow rate adjustment valves 124*a*, 226*a*, 142*a* and the operation of the blowers 135, 141*b* so that the oxygen concentration measured by the oxygen sensor 123*a* is equal to or less than a predetermined value X %, for example, 12%.

In the present embodiment, control means is configured from the control device 571. The coal inactivation processing apparatus 500 is configured from the control means, similar equipment as the second embodiment described above, and the like. The other means are configured from similar equipment as the second embodiment described above.

In the coal inactivation processing apparatus 500 according to the present embodiment that includes the control device 571, it is possible to produce the modified coal 5 from the low rank coal 1 by causing the same central operation as the coal inactivation processing apparatus 200 according to the second embodiment as described previously.

Also, the control device 571 controls the lift of the flow rate control valves 124*a*, 142*a*, 226*a* and the operation of the blowers 135, 141*b*, 154*a* so that the temperature T measured by the temperature sensor 103*a* is equal to or less than a predetermined temperature Y, for example, 90° C. Also, the control device 571 controls the lift of the flow rate adjustment valves 124*a*, 226*a*, 142*a* and the operation of the blowers 135, 141*b* so that the oxygen concentration measured by the oxygen sensor 123*a* is equal to or less than a predetermined value X %, for example, 12%.

Therefore, according to the present embodiment, by controlling the various equipment by the control device 571 based on the temperature of the coal 4 within the rotary kiln assembly 103 and the oxygen concentration of the process gas 13 flowing within the low oxygen process gas supply pipe 123, it is possible to reliably control the rate of progress of the inactivation process of the coal 4 while preventing spontaneous combustion of the coal 4 within the rotary kiln assembly 103, and more stably carry out the inactivation process of the coal 4.

Sixth Embodiment

Figure 9:
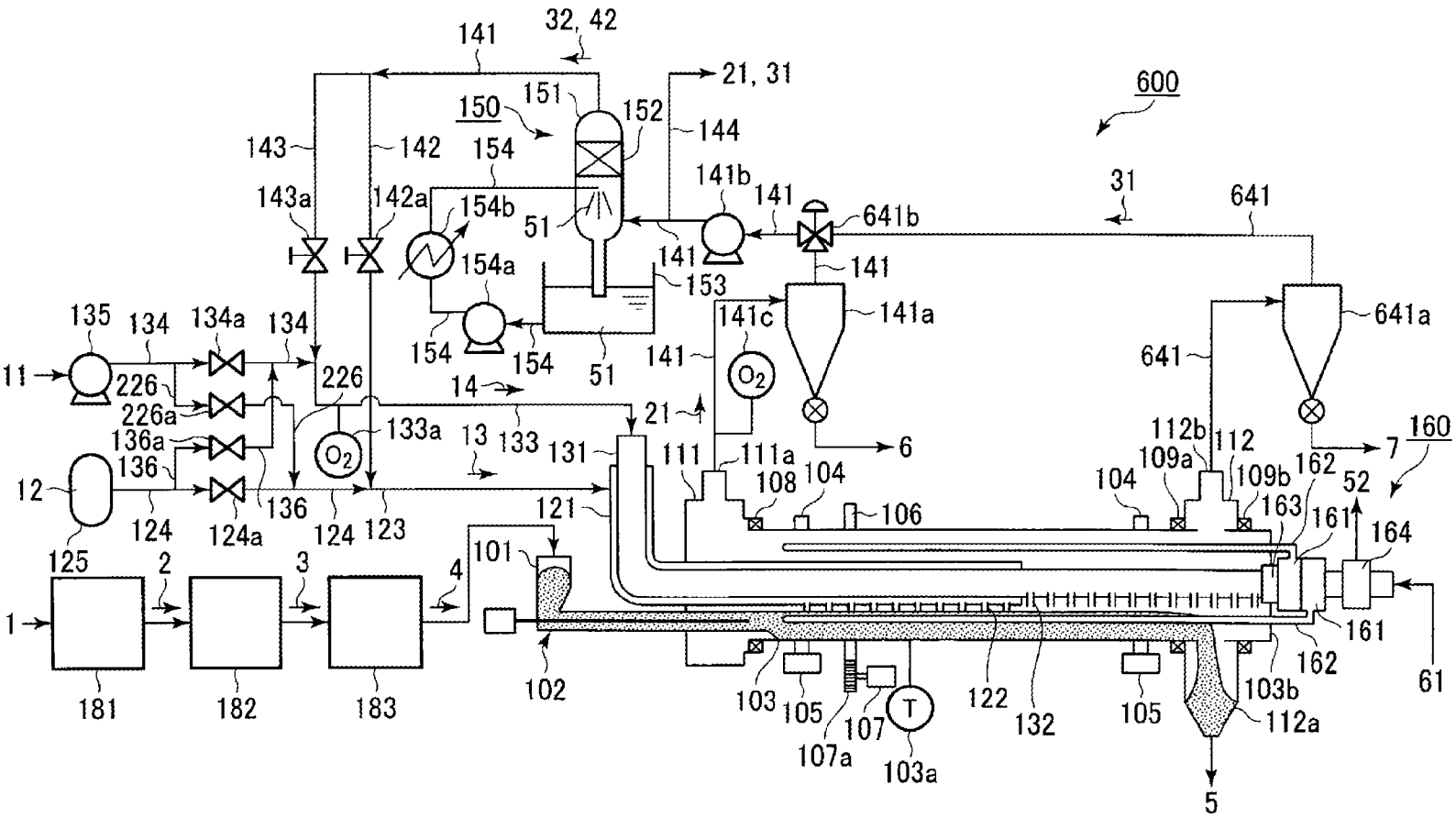
FIG. 9 is a schematic view of the configuration of a sixth embodiment of the coal inactivation processing apparatus according to the present invention.
Figure 10:
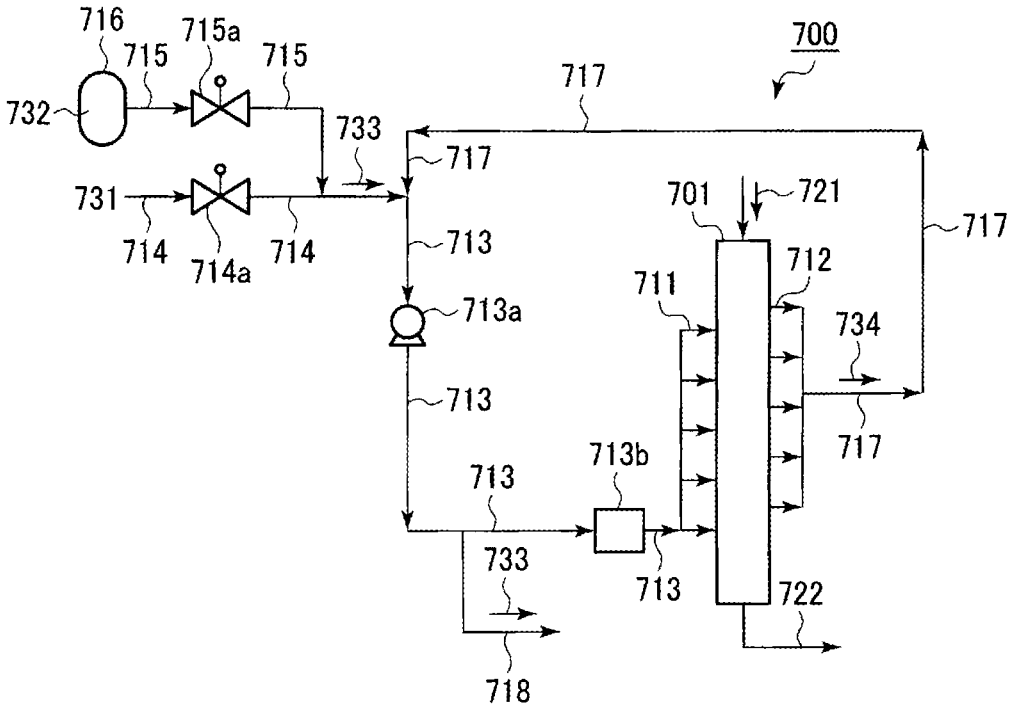
FIG. 10 is a schematic view of the configuration of a conventional coal inactivation processing apparatus.

The following is a description of a sixth embodiment of the coal inactivation processing apparatus according to the present invention based on FIG. 9.

The present embodiment is configured by adding a second circulation pipe and a three-way valve to the first embodiment as described above and as illustrated in FIG. 1. The rest of the configuration is generally the same as that described above and illustrated in FIG. 1, so the same equipment is given the same reference numeral and duplicated descriptions are omitted as appropriate.

As illustrated in FIG. 9, a coal inactivation processing apparatus 600 according to the present embodiment includes a second circulation pipe 641 connected at the base end side thereof to the gas discharge outlet 112*b* of the distal end side casing 112 provided on the distal end side of the rotary kiln assembly 103. The distal end side of the second circulation pipe 641 is connected between the cyclone 141*a* and the blower 141*b* of the circulation pipe 141, via a three-way valve 641*b*. A cyclone 641*a* is provided between the base end side and the distal end side of the second circulation pipe 641. In this way, it is possible to switch discharge of the process gas 21 from the base end side casing 111 and discharge of the process gas 31 from the distal end side casing 112 in accordance with the components of the coal 4 supplied to the rotary kiln assembly 103.

In this embodiment, switching means is configured from the three-way valve 641*b*, and the like. Circulation means is configured from the second circulation pipe 641, the cyclone 641*a*, the switching means, similar equipment as the first embodiment as described above, and the like. The base end side process gas supply means is configured from the circulation means, and otherwise similar equipment as the first embodiment as described above, and the like. The distal end side process gas supply means is configured from the circulation means, and otherwise similar equipment as the first embodiment as described above, and the like. The coal inactivation processing apparatus 600 is configured from the base end side process gas supply means, the distal end side process gas supply means, the circulation means, and otherwise similar equipment as the first embodiment as described above, and the like. The other means are configured from similar equipment as the first embodiment described above.

In the coal inactivation processing apparatus 600 according to the present embodiment that includes the gas discharge outlet 112*b*, the second circulation pipe 641, the cyclone 641*a*, and the three-way valve 641*b*, it is possible to produce the modified coal 5 from the low rank coal 1 by causing the same central operation as the coal inactivation processing apparatus 100 according to the first embodiment as described above.

Also, the connection direction of the three-way valve 641*b* is controlled so that the process gas used in the inactivation process of the coal 4 within the rotary kiln assembly 103 is discharged from the gas discharge outlet 111*a* of the base end side casing 111 or the gas discharge outlet 112*b* of the distal end side casing 112, in accordance with the components of the coal 4 transported into the rotary kiln assembly 103 by the hopper 101 and the screw feeder 102. In other words, when the process gas 21 is discharged from the gas discharge outlet 111*a* of the base end side casing 111, the three-way valve 641*b* is controlled so that the cyclone 141*a* side and the blower 141*b* side of the circulation pipe 141 are communicated. When the process gas 31 is discharged from the gas discharge outlet 112*b* of the distal end side casing 112, the three-way valve 641*b* is controlled so that the distal end side of the second circulation pipe 641 is communicated between the blower 141*b* and the cyclone 141*a* on the circulation pipe 141.

Therefore, according to the present embodiment, it is possible to control the connection direction of the three-way valve 641*b* so that the used process gas used in the process of inactivation of the coal 4 in the rotary kiln assembly 103 flows in the direction opposite to the direction of transport of the coal 4, or flows in the same direction as the direction of transport of the coal 4. Therefore, it is possible to select the speed of progress of the inactivation process and stably carry out the inactivation process of the coal 4, in accordance with the components of the coal 4 supplied within the rotary kiln assembly 103.

Other Embodiments

Note that in the above, coal inactivation processing apparatus 100, 200, 300, 400, 500, 600 that include a single temperature sensor 103*a* have been described, but the coal inactivation processing apparatus provided with a plurality of temperature sensors from the base end side to substantially the center portion in the longitudinal direction of the rotary kiln assembly 103 is also possible.

In the above, coal inactivation processing apparatus 100, 200, 300, 400, 500, 600 have been described in which the process gas 13 containing oxygen in low concentration is blown to the coal 4 within the rotary kiln assembly 103 from the base end side to substantially the center portion in the longitudinal direction of the rotary kiln assembly 103, and the process gas 14 containing oxygen in high concentration is blown from substantially the center portion in the longitudinal direction to the distal end side of the rotary kiln assembly 103. However, a coal inactivation processing apparatus that blows the process gas 13 containing oxygen in low concentration to the coal 4 within the rotary kiln assembly 103 over a range of 30% to 70% of the base end side of the rotary kiln assembly 103, and blows the process gas 14 containing oxygen in high concentration to the coal 4 within the rotary kiln assembly 103 over a range of 70% to 30% of the distal end side of the rotary kiln assembly 103 is also possible. This increases the reaction per unit time of the oxygen in the process gas 13, 14, with the coal 4. In other words, the oxygen adsorption speed is larger in the region of the base end side of the rotary kiln assembly 103 where the carbon activation immediately after pyrolyzing the coal 4 supplied within the rotary kiln assembly 103 is high, and the temperature is high. Therefore, oxygen adsorption can easily occur in the region 30% to 70% (50±20%) of the base end side of the rotary kiln assembly 103, and oxygen adsorption is more difficult to occur in the region 30% to 70% (50±20%) of the distal end side of the rotary kiln assembly 103 compared with the region 70% to 30% (50±20%) of the base end side of the rotary kiln assembly 103.

In the above, the use of an inactivation processing apparatus 400 that includes the discharge pipes 445 with the distal end thereof located in substantially the center portion in the longitudinal direction of the rotary kiln assembly 103, and the base end side thereof connected to the base end side of the circulation pipe 141 was described. However, a coal inactivation processing apparatus that includes discharge pipes with the distal ends thereof located within the range from substantially the center portion in the longitudinal direction to the distal end side of the rotary kiln assembly 103, and the base end side thereof connected to the base end side of the circulation pipe 141 is also possible.

In the above, the coal inactivation processing apparatus 100, 200, 300, 400, 500, 600 that include the temperature and humidity adjustment device 150 provided on the circulation pipe 141 were described. However, a coal inactivation processing apparatus provided with the temperature and humidity adjustment device 150 in the low oxygen process gas supply pipe 123, the inert gas supply pipe 124, the high oxygen process gas supply pipe 133, the air supply pipe 134, and the branch circulation pipes 142, 143 is also possible.

In the above, the coal inactivation processing apparatus 100, 200, 300, 400, 500, 600 that include the circulation pipe 143 connected to the distal end side of the circulation pipe 141, 341 and the base end side of the high oxygen process gas supply pipe 133 were described, but a coal inactivation processing apparatus that does not include the circulation pipe 143 is also possible.

In the above, the coal inactivation processing apparatus 100, 200, 300, 400, 500, 600 that include the circulation pipes 141 to 143, 341, 641 were described, but a coal inactivation processing apparatus that does not include the circulation pipes 141 to 143, 341, 641 is also possible.

INDUSTRIAL APPLICABILITY

The coal inactivation processing apparatus according to the present invention can produce inactivated coal in a short period of time while preventing spontaneous combustion, so it can be extremely beneficially used in industry.

REFERENCE SIGNS LIST

1 Low-grade coal (low rank coal)
2 Dried coal
3 Pyrolyzed coal
4 Coal
5 Modified coal
6,7 Pulverized coal
11 Air
12 Inert gas
13 Low oxygen process gas
14 High oxygen process gas
21 Used gas
22 Temperature and humidity adjusted used gas
31 Used gas
32 Temperature and humidity adjusted used gas
41 Used gas
42 Temperature and humidity adjusted used gas
51 Water (water for temperature and humidity adjustment)
61 Cooling water
62 Used cooling water
100 Coal inactivation processing apparatus
101 Hopper
102 Screw feeder
103 Rotary kiln assembly (rotary apparatus assembly)
103*a* Temperature sensor
104 Protrusion
105 Rollers
106 Gear
107 Drive electric motor
107*a* Gear
108 Seal device
109*a*, 109*b* Seal device
111 Base end side casing
111*a* Gas discharge outlet
112 Distal end side casing
112*a* Chute
112*b* Gas discharge outlet
121 Low oxygen process gas introduction pipe
122 Jet Nozzle
122*a* Tip end
123 Low oxygen process gas supply pipe
123*a* Oxygen sensor
124 Inert gas supply pipe
124*a* Flow rate adjustment valve
125 Inert gas supply source
131 High oxygen process gas introduction pipe
132 Jet Nozzle
132*a* Tip end
133 High oxygen process gas supply pipe
133*a* Oxygen sensor
134 High oxygen process gas supply pipe
134*a* Flow rate adjustment valve
135 Blower
136 Connecting pipe
136*a* Flow rate adjustment valve
141 Circulation pipe
141*a* Cyclone
141*b* Blower
142 Branch circulation pipe
142*a* Flow rate adjustment valve
143 Branch circulation pipe
143*a* Flow rate adjustment valve
144 Air discharge pipe
150 Temperature and humidity adjustment device
151 Process column (apparatus assembly)
152 Packing material
153 Water storage tank
154 Supply pipe
154*a* Blower
154*b* Diffuser
160 Cooling device
161 Cooling water supply header
162 Supply pipe
163 Bearing
164 Cooling water discharge header
181 Dryer
182 Pyrolyzer
183 Cooler
200 Coal inactivation processing apparatus
226 Connecting pipe
226*a* Flow rate adjustment valve
300 Coal inactivation processing apparatus
341 Circulation pipe
341*a* Cyclone
341*b* Blower
400 Coal inactivation processing apparatus
445 Discharge pipe
500 Coal inactivation processing apparatus
571 Control device
600 Coal inactivation processing apparatus
641 Second circulation pipe
641*a* Cyclone
641*b* Three-way valve

The invention claimed is:

1. A coal inactivation processing apparatus that inactivates coal using process gas that contains oxygen, comprising:

a rotary kiln assembly for passing the coal from a base end side to a distal end side in the rotary kiln assembly while rotating to agitate the coal;

base end side process gas supply means for supplying the process gas to the base end side of the interior of the rotary kiln assembly;

distal end side process gas supply means for supplying the process gas to the distal end side of the interior of the rotary kiln assembly;

process gas oxygen concentration adjusting means for adjusting the oxygen concentration of the process gas supplied to the interior of the rotary kiln assembly cooling means for cooling the coal in the interior of the rotary kiln assembly from the base end side to the distal end side in the rotary kiln assembly;

process gas discharge means for discharging the process gas used in the interior of the rotary kiln assembly, and circulation means for circulating the process gas discharged by the process gas discharge means to the base end side process gas supply means;

wherein the process gas discharge means includes base end side process gas discharge means provided on the base end side of the rotary kiln assembly, and distal end side process gas discharge means provided on the distal end side of the rotary kiln assembly, and the circulation means includes switching means for switching a connection between the base end side process gas discharge means and the base end side process gas supply means, and a connection between the distal end side process gas discharge means and the base end side process gas supply means.

2. The coal inactivation processing apparatus according to claim 1, wherein the process gas oxygen concentration adjusting means includes distal end side oxygen concentration adjusting means for adjusting the oxygen concentration in the process gas supplied by the distal end side process gas supply means, and base end side oxygen concentration adjusting means for adjusting the oxygen concentration in the process gas supplied by the base end side process gas supply means to be lower than the oxygen concentration of the process gas supplied by the distal end side process gas supply means.

3. The coal inactivation processing apparatus according to claim 2, wherein the base end side oxygen concentration adjusting means adjusts the oxygen concentration of the process gas supplied by the base end side process gas supply means to be equal to or less than 12%, and the distal end side oxygen concentration adjusting means adjusts the oxygen concentration of the process gas supplied by the distal end side process gas supply means to be equal to or less than 21%.

4. The coal inactivation processing apparatus according to claim 2, further comprising:

a rotary kiln assembly internal temperature measuring means for measuring a temperature of the interior of the rotary kiln assembly, process gas oxygen concentration measuring means for measuring the oxygen concentration of the process gas supplied to the interior of the rotary kiln assembly, and control means for controlling the process gas oxygen concentration adjusting means based on information from the rotary kiln assembly internal temperature measuring means and the process gas oxygen concentration measuring means.

5. The coal inactivation processing apparatus according to claim 4, wherein the rotary kiln assembly internal temperature measuring means includes base end side temperature measuring means for measuring the temperature of the interior of the base end side of the rotary kiln assembly, the process gas oxygen concentration measuring means includes base end side oxygen concentration measuring means for measuring the oxygen concentration of the process gas supplied by the base end side process gas supply means, and the control means controls the base end side oxygen concentration measuring means based on information from the base end side temperature measuring means and the base end side oxygen concentration measuring means.

6. The coal inactivation processing apparatus according to claim 5, wherein the control means controls the base end side oxygen concentration adjusting means so that the temperature measured by the base end side temperature measuring means is equal to or less than 90° C., and, the oxygen concentration measured by the base end side oxygen concentration measuring means is equal to or less than 12%.

7. The coal inactivation processing apparatus according to claim 1, further comprising:

humidification means for humidifying the process gas supplied to the interior of the rotary kiln assembly.

* * * * *